US006443649B1

(12) United States Patent
Koyama et al.

(10) Patent No.: US 6,443,649 B1
(45) Date of Patent: Sep. 3, 2002

(54) FREE-INK TYPE WRITING INSTRUMENT

(75) Inventors: Takao Koyama, Ashikaga; Kazuhisa Kirita, Gunma; Atsushi Iwasa, Saitama, all of (JP)

(73) Assignee: Mitsubishi Pencil Kabushiki Kaisha (JP)

( * ) Notice: Subject to any disclaimer, the term of this patent is extended or adjusted under 35 U.S.C. 154(b) by 0 days.

(21) Appl. No.: 10/011,782

(22) Filed: Dec. 11, 2001

(30) Foreign Application Priority Data

Dec. 27, 2000 (JP) ..... 2000-397277

(51) Int. Cl.[7] ..... B43K 5/18
(52) U.S. Cl. ..... 401/225; 401/224; 401/227
(58) Field of Search ..... 401/225, 222, 401/223, 224, 227, 221, 226, 198, 199

(56) References Cited

U.S. PATENT DOCUMENTS 5,556,215 A * 9/1996 Hori ..... 401/199
6,340,259 B2 * 1/2002 Mito et al. ..... 401/198

* cited by examiner

*Primary Examiner*—David J. Walczak
(74) *Attorney, Agent, or Firm*—Burns, Doane, Swecker & Mathis, L.L.P.

(57) ABSTRACT

A free-ink type writing instrument includes: an ink tank for holding ink; a temporary ink collector for temporarily retaining the ink flowing out from the ink tank; a partitioning wall separating the ink tank and the temporary ink collector; and a pen core disposed from the ink tank, penetrating through the partitioning wall and the ink collector so as to allow ink to flow out from the ink tank, and is characterized in that the storage volume Vc of the ink collector and the ink tank volume Vo satisfy the relation Vc≧0.18 Vo.

1 Claim, 6 Drawing Sheets

FREE-INK TYPE WRITING INSTRUMENT

BACKGROUND OF THE INVENTION (1) Field of the Invention

The present invention relates to a free-ink type writing instrument having an ink collector which temporarily stores ink flowing out when the pressure inside the ink tank increases.

(2) Description of the Prior Art

There have been free-ink type writing instruments which include a temporary ink collector arranged radially outside, and separated from, the ink feed (or pen core) connected to the ink tank and made up of a molding having a comb-toothed section or which include a temporary ink collector made up of a porous structure connected to the ink feed. In such free-ink type writing instruments, it is usual that a water-based ink having a surface tension of 30 mN/m or greater at a temperature of 25° C. is charged in its ink tank.

In such a free-ink type writing instrument, ink is pushed out from the ink tank when the pressure inside the air volume in the ink tank increases, and the ink is temporarily held in the ink collector, which prevents ejection of ink from the pen tip.

In recent years, traveling by airplane has become commonplace. When a free-ink type writing instrument is carried under such circumstances, the differential pressure between the interior of the ink tank and external atmosphere changes sharply. Therefore, the air volume inside the ink tank expands and this may cause ink leakage from the pen tip. For example, there is a free-ink type writing instrument which will not cause any ink ejection or leakage when the temperature changes are within the range of 25° C. to 50° C. under a normal environment. Even with such a pen, if it undergoes a more severe pressure change than a temperature change from 25° C. to 50° C. due to in-flight pressure in a plane in transit dropping to about 0.8 to 0.7 atm., the free-ink type writing instrument of the conventional design will suffer from ink leakage from the writing tip.

Conventionally, oil-based makers have been used as writing instruments for drawing on a non-absorptive writing surface having poor wettability, such as of polypropylene or the like because their drawn lines dry fast and no drawn line is repelled. Generally,such makers use organic solvents having a vapor pressure higher than water. An ink having a high vapor pressure sharply changes in vapor pressure with change in temperature, so the pressure of the empty space inside the ink tank increases shapely. As a result, when the air expands so that the pressure is relieved, the problems of ink leaking from the writing point often occur.

For example, the water vapor pressure of a water-based ink is about 23.8 mmHg at a temperature of 25° C. If lines are drawn on non-absorptive surfaces such as plastic films of polypropylene, polyethylene, polyethylene terephthalate, etc., glass surfaces, metallic surfaces and the like, the drawn lines cannot but exhibit poor dryability. There is also another problem of drawn lines being repellent when a water-based ink having a surface tension of about 30 mN/m or greater at a temperature of 25° C. is used to draw lines on a writing surface with poor wettability, e.g., resin surfaces of polypropylene, polyethylene, etc., or glass surfaces and the like with sebum adhering thereon.

SUMMARY OF THE INVENTION

It is therefore an object of the present invention to provide a free-ink type writing instrument which is able to use an ink having resistance against drawn line repellence on a writing surface with a poor wettability and excellent in drawn line dryability, still can retain all the ink flowing out from the ink tank by the temporary ink collector without causing any ink leakage such as ink ejection from the writing tip if a sharp change in external pressure or sharp expansion or contraction of air inside the ink tank occurs and which can be assembled easily at a low cost by automation.

In order to achieve the above object, the present invention is configured as follows:

In accordance with the aspect of the present invention, a free-ink type writing instrument includes: an ink tank for holding ink; a temporary ink collector for temporarily retaining the ink flowing out from the ink tank; a partitioning wall separating the ink tank and the temporary ink collector; and a pen core disposed from the ink tank, penetrating through the partitioning wall and the ink collector so as to allow ink to flow out from the ink tank, and is characterized in that the ink stored in the ink tank has a vapor pressure ranging from 20 mmHg to 60 mmHg at a temperature of 25° C. and a surface tension of less than 30 mN/m at a temperature of 25° C., and the storage volume Vc of the ink collector and the ink tank volume Vo satisfy the relation $Vc \geqq 0.18\ Vo$.

In the present invention, any of the following features is effective: that the main solvent is of an organic solvent or water; that the temporary ink collector is a sectionally comb-shaped, columnar molding formed of a multiple number of plates arranged in layers predetermined gaps apart or a group of multiple vanes arranged in layers with gaps so as to be able to retain ink within the gaps; and that the pen core is of a fiber bundle core.

DESCRIPTION OF THE PREFERRED EMBODIMENTS

The embodiments of the present invention will hereinafter be described in detail with reference to the accompanying drawings. However, the free-ink type writing instrument of the present invention should not be limited to the embodiments and examples to be shown herein.

Figure 1:
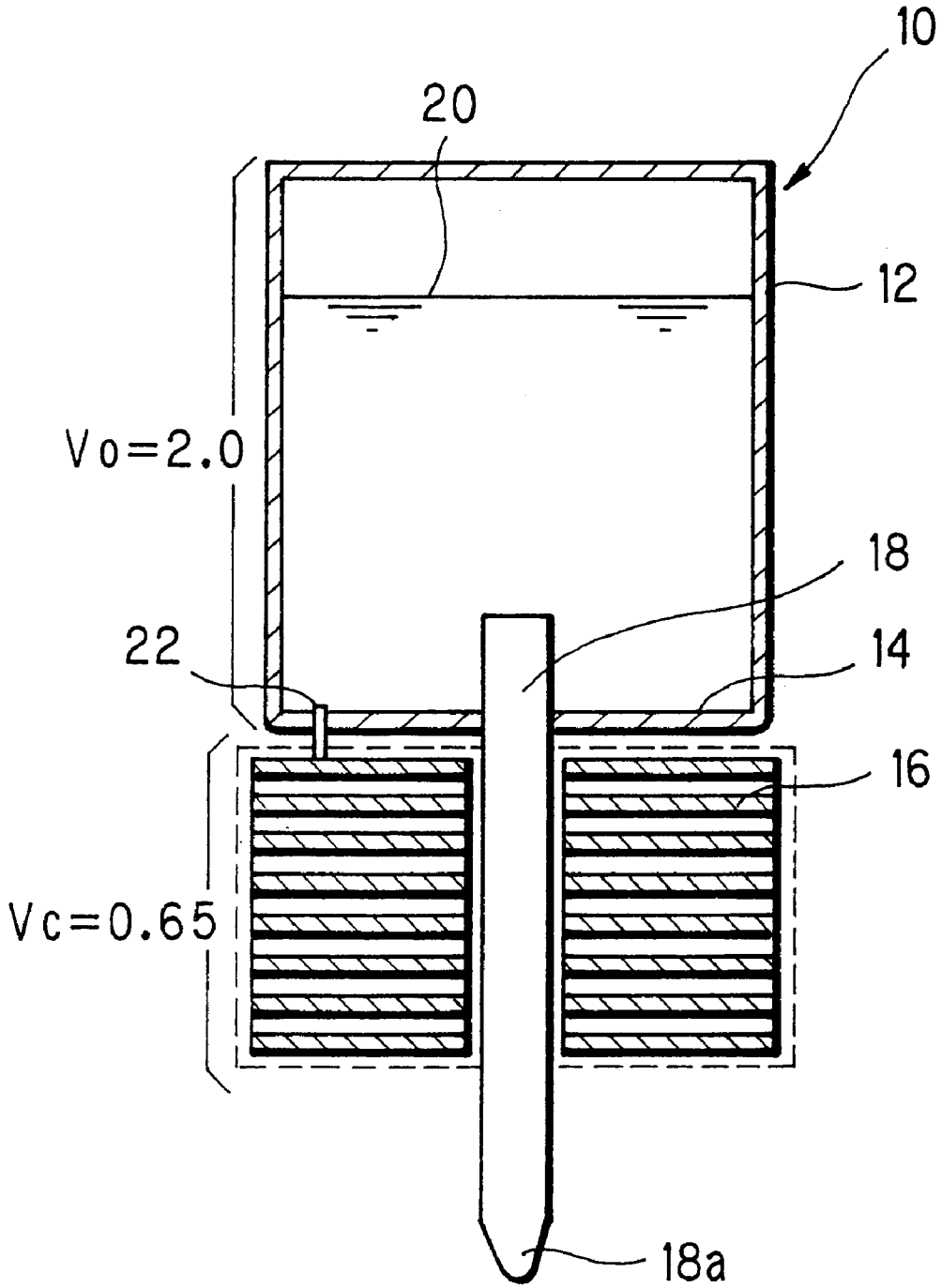
FIG. 1 is an overall sectional view showing the first embodiment of a free-ink type writing instrument according to the present invention.
Figure 2:
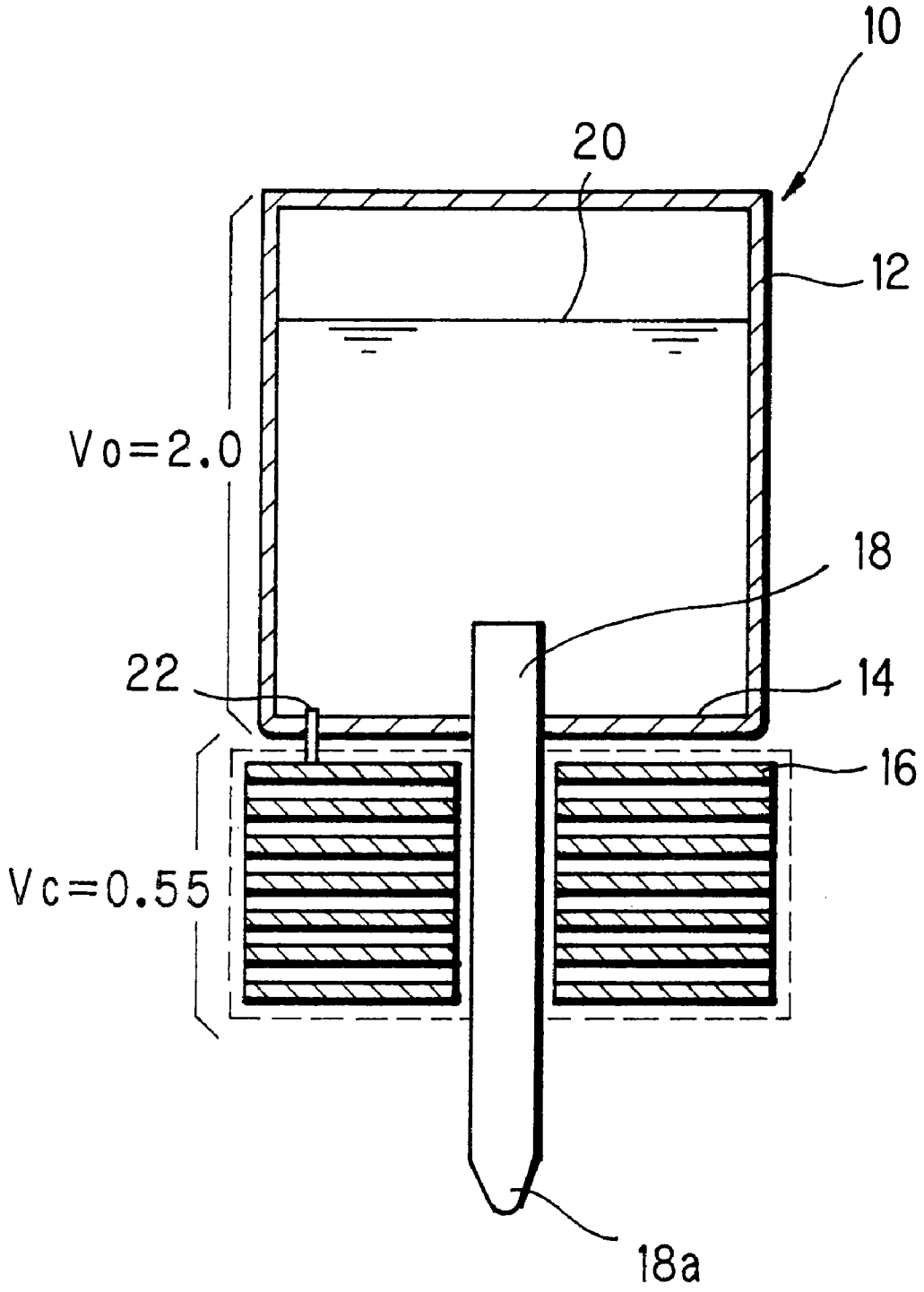
FIG. 2 is an overall sectional view showing the second embodiment of a free-ink type writing instrument according to the present invention.
Figure 3:
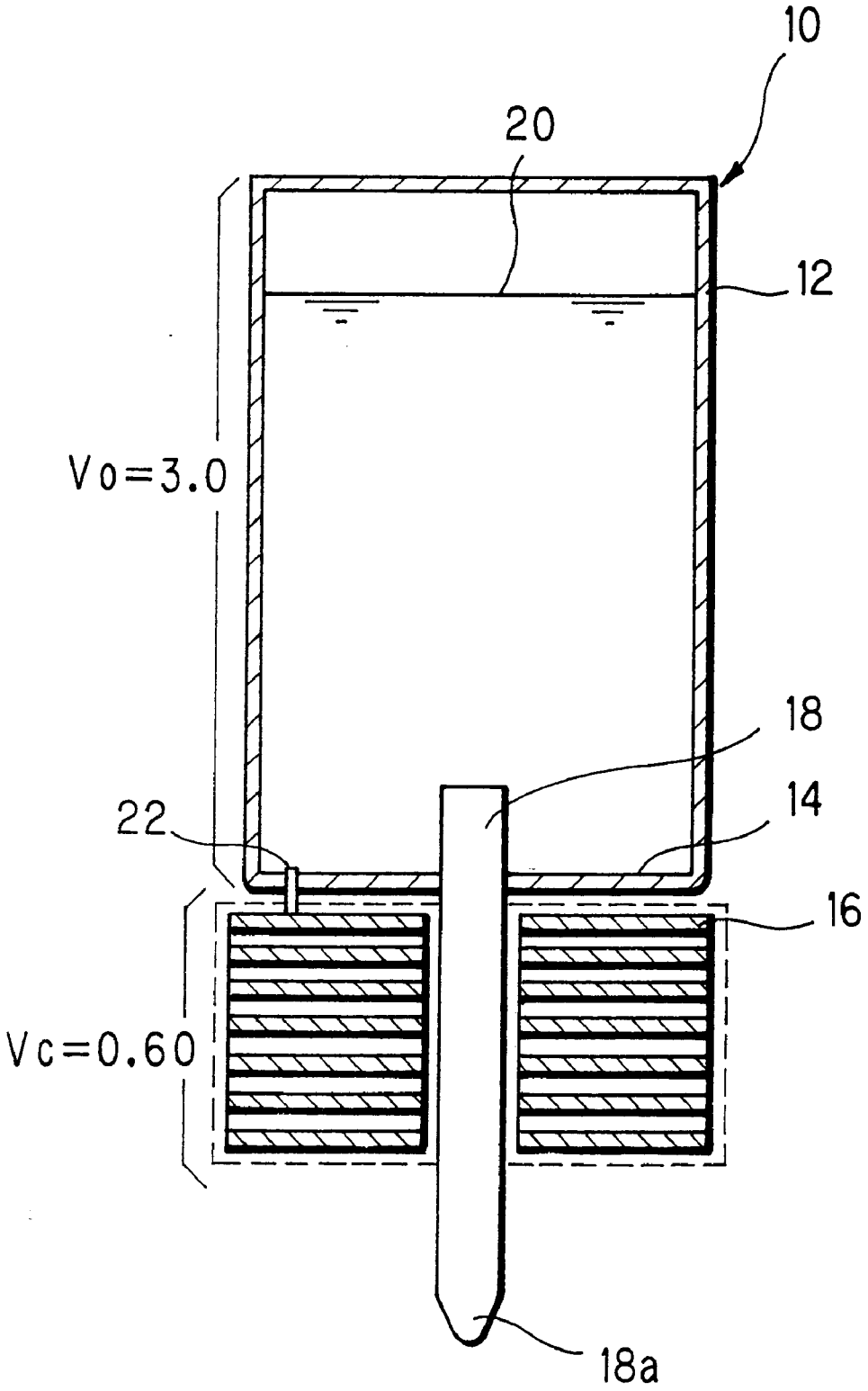
FIG. 3 is an overall sectional view showing the third embodiment of a free-ink type writing instrument according to the present invention.
Figure 4:
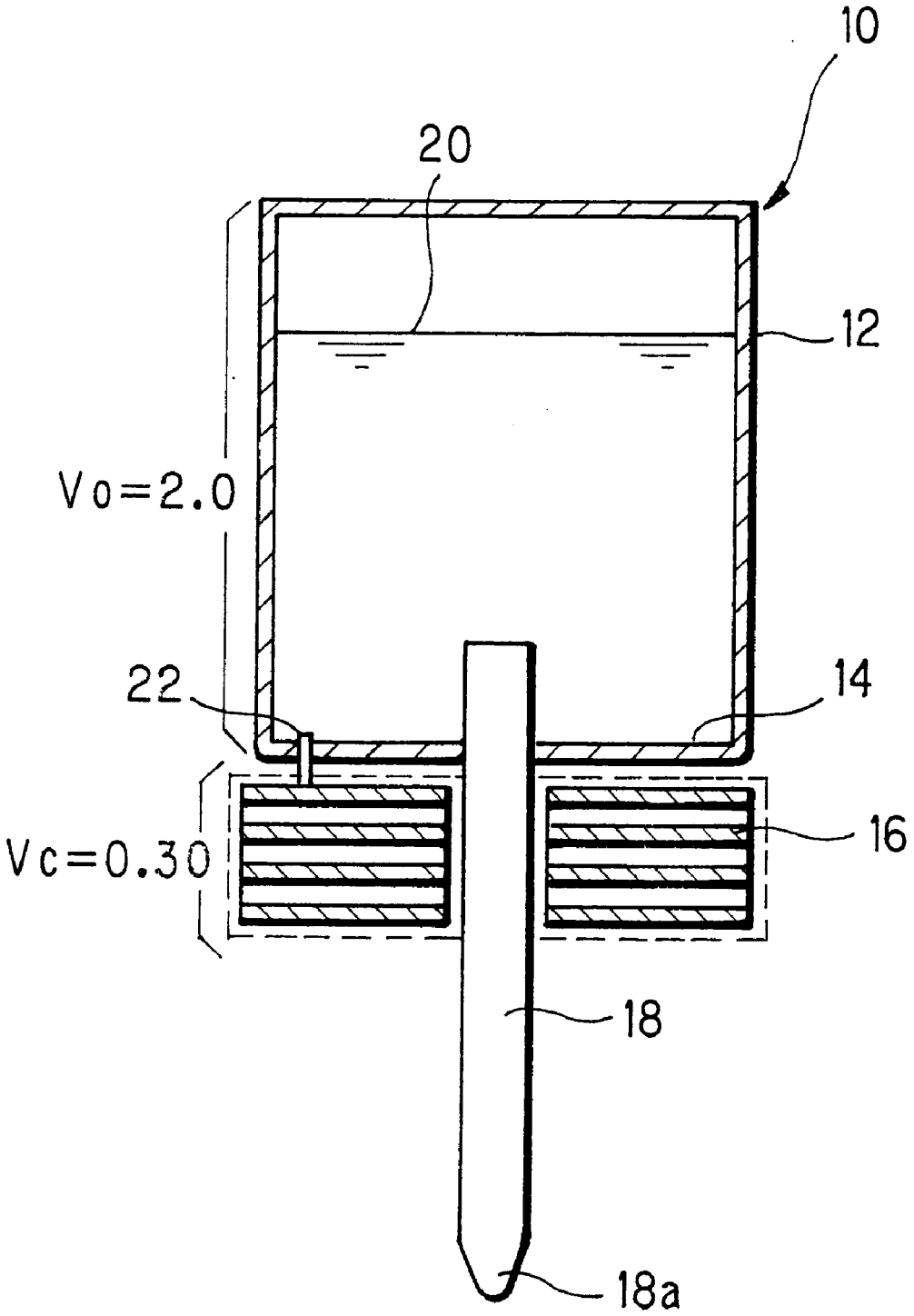
FIG. 4 is an overall sectional view showing a free-ink type writing instrument of a comparative example.

FIG. 1 is an overall sectional view showing the first embodiment of a free-ink type writing instrument according to the present invention. FIG. 2 is an overall sectional view showing the second embodiment of a free-ink type writing instrument according to the present invention. FIG. 3 is an overall sectional view showing the third embodiment of a free-ink type writing instrument according to the present invention. FIG. 4 is an overall sectional view showing a free-ink type writing instrument of a comparative example.

Figure 5:
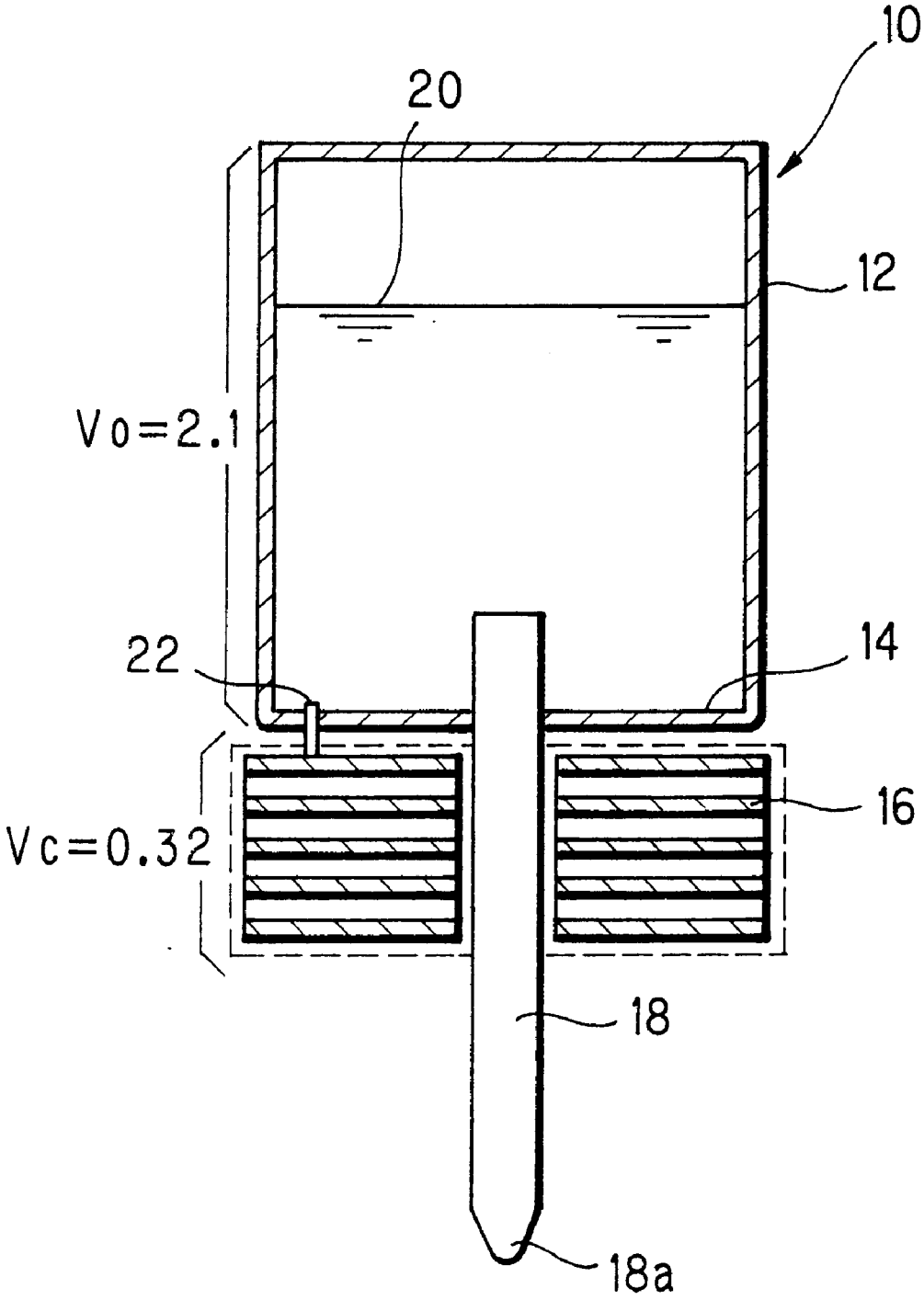
FIG. 5 is an overall sectional view of a free-ink type writing instrument of another comparative example.
Figure 6:
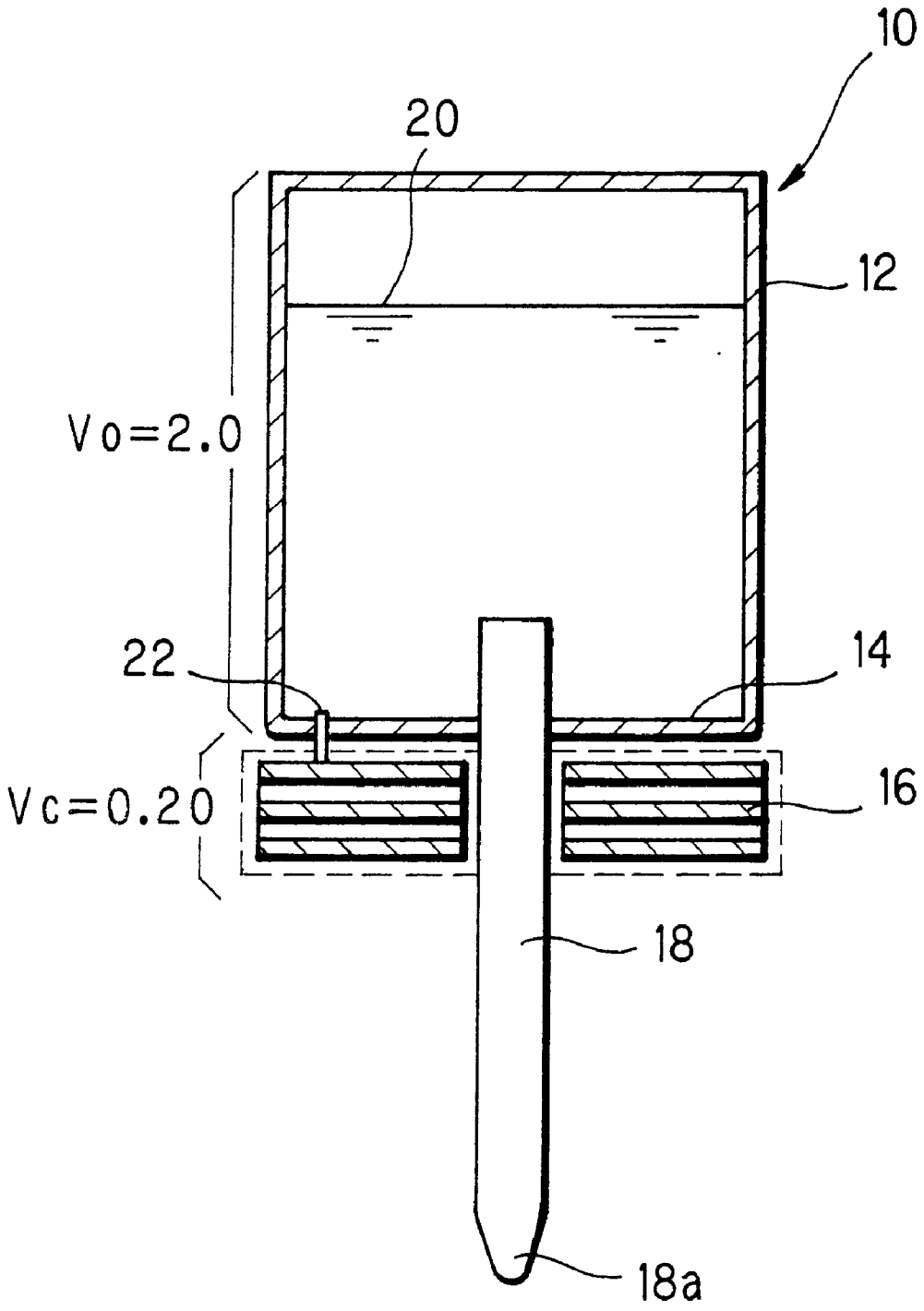
FIG. 6 is an overall sectional view of a free-ink type writing instrument of a further comparative example.

FIGS. 5 and 6 are overall sectional views of free-ink type writing instruments of comparative examples.

As shown in FIGS. 1 and 2, a free-ink type writing instrument 10 according to the present invention is constructed such that a partitioning wall 14 is provided between an ink tank 12 and a temporary ink collector 16 with a pen core 18 penetrated from the interior of ink tank 12 through partitioning wall 14 and ink collector 16 so that ink 20 flowing out through pen core 18 from ink tank 12 can be temporarily held in ink collector 16. In this free-ink type writing instrument 10, the storage volume Vc of ink collector 16 and the ink tank volume Vo satisfy the relation $Vc \geqq 0.18\ Vo$.

The pen core 18 functions as the ink feed for feeding ink 20 from ink tank 12, and its point 18 a serves as the writing portion. The pen core 18 is preferably a fiber bundle core. With the pen core made up of a fiber bundle or the like, ink can be smoothly delivered from ink tank 12 to the point 18*a* of pen core 18. This pen core 18 is constructed of one element, but it is possible to provide a pen core which is comprised of two or more elements, e.g., front and rear parts formed in different manners and materials.

The above ink collector 16 is comprised of a sectionally comb-shaped molding. However, as a temporary ink collector 16, any configuration can be employed as long as it can quickly absorb and store flowed out ink 20. For example, it may be a sectionally comb-shaped molding having a multiple number of planar plates arranged in layers with predetermined gaps apart for retaining ink therebetween, a multiple number of vanes arranged in layers with predetermined gaps apart for retaining ink therebetween, an ink absorptive porous element having a porous structure presenting capillarity, or the like.

In free-ink type writing instrument 10 of the present invention, the aforementioned sectionally comb-shaped molding 16 or a group of vanes is preferably used as the temporary ink collector. The sectionally comb-shaped molding is a cylindrical molding or square column-shaped molding having a multiple number of plates such as discs, square plates, etc., arranged apart and in layers with predetermined gaps, so as to retain or store outflowed ink 20 by virtue of capillary action between the plates arranged in layers. The sectionally comb-shaped molding has pen core 18 penetrating therethrough in its center so that it can efficiently absorb outflowed ink 20. This sectionally comb-shaped molding configuration is especially preferred for a temporary ink collector of a large capacity because it is comparatively easy-moldable and low in cost even when a large retention volume is needed. Concerning the vane configuration, this can be simply produced by stacking vane-like elements such as film elements in layers and the volume of the temporary ink collector can be easily varied by changing the amount of film layers.

As to temporary ink collectors made up of fiber bundles or porous articles such as sponge, etc., their cost generally becomes higher as the volume increases and they may sometimes have difficulties when assembled by automation because of their mechanical strength.

Free-ink type writing instrument 10 of the present invention is constructed such that the storage volume Vc of temporary ink collector 16 and the volume Vo of ink tank 12 satisfy the relation $Vc \geqq 0.18\ Vo$. This specification limiting the storage volume Vc of temporary ink collector 16 being equal to or greater than 0.18 times of the ink tank volume Vo, enables retention of all outflowed ink within the temporary ink collector without causing any ink leakage such as ink ejection from the writing tip or the like, even when with a sudden change in external pressure, an abrupt expansion or contraction of the air inside the ink tank occurs. Further, this specification enables a temporary ink collector to retain ink without causing any ink ejection from the writing tip or the like, and even when an ink consisting of a solvent having a high vapor pressure is used or when pressure change occurs during air travel.

In particular, concerning the relation between the storage volume Vc and the ink tank volume Vo, it is preferable if $1.0\ Vo \geqq Vc \geqq 0.18\ Vo$ holds or more preferable if $0.6\ Vo \geqq Vc \geqq 0.2\ Vo$ holds. The specifications as above make it possible for the temporary ink collector to reliably retain the outflowed ink against an abrupt air expansion even when the ink inside the ink tank has been already consumed and a considerably large empty space occupies the ink tank. On the other hand, the greater the storage volume Vc of the temporary ink collector, the more advantageous against ambient changes. However,to make the temporary ink collector so large that it thoughtlessly exceeds the above range may cause technical difficulties in molding the temporary ink collector of a comb-shaped molding described above. This is not good from the economical and global environmental view points because of waste of material.

In free-ink type writing instrument 10 of the present invention, ink 20 stored in ink tank 12 should have a vapor pressure of 20 to 60 mmHg at a temperature of 25° C.

For an ink excellent in drawn line drying property being needed, the ink should have a greater vapor pressure equal to or greater than that of water and preferably has a vapor pressure ranging from 40 mmHg to 60 mmHg at a temperature of 25° C. For such a quick drying ink, the aftermentioned organic solvents can be used, which is suitable for publicly known oil-based markers or water-based markers where good adhesiveness is required. Such a free-ink type writing instrument 10 with the ink as above presents excellency in drawn line drying property and is free from ink leakage at the writing tip of ink 20 pushed out from the ink tank 12 side even if an abrupt positive or negative change in the pressure of ink tank 12 occurs due to sudden change in temperature because temporary ink collector 16 has a large enough storage volume Vc to cope with ink tank 12.

In free-ink type writing instrument 10 according to the present invention, the ink 20 preferably has a surface tension of less than 30 mN/m, more preferably equal to 27 mN/m or lower at a temperature of 25° C.

When the surface tension of ink 20 is less than 30 mN/m, no repellence of drawn lines occurs even when the ink is delivered onto a writing surface poor in wettability, such as a resin surface of polyethylene or polypropylene, glass surface with sebum adhering thereon, or the like.

In free-ink type writing instrument 10 according to the present invention, the main solvent of the ink 20 is water or an organic solvent. In particular, use of an organic solvent is preferable in order to present the above vapor pressure and the above surface tension.

As the organic solvents, any organic solvent can be used as long it is generally used for writing instruments. For example, monohydric alcohols such as ethanol, butanol, n-propanol, etc., dihydric alcohols such as polypropylene glycol mono-methyl-ether, ethylene glycol mono-methyl-ether, and polyhydric alcohols such as glycerin can be used solely or in combination.

In free-ink type writing instrument 10 of the present invention, as shown in FIG. 1, an air replacement passage 22 may be formed in partitioning wall 14. Air replacement hole 22 may be provided as a connecting passage that has openings at its ends and creates communication between ink tank 12 and temporary ink collector 16 penetrating through partitioning wall 14 or as a connecting tube disposed inside temporary ink collector 16. The form of air replacement hole 22 may be selected as appropriate. In free-ink type writing instrument 10 of the present invention, when temporary ink collector 16 is formed of a sectionally comb-shaped molding, the air replacement passage or hole is preferably formed through partitioning wall 14 so as to have a narrower size than the gaps between combed teeth.

In free-ink type writing instrument 10 of the present invention, since the storage volume Vc of temporary ink collector 16 is high enough compared to the ink tank volume Vo, it is possible to fully store ink flowed out from ink tank 12 within temporary ink collector 16 even when an abrupt change in external pressure, etc., occurs upon boarding on an airplane. Further, even if ink 20 in ink tank 12 is made up of a solvent having a high volatility and a high vapor pressure hence the air volume in ink tank 12 sharply expands due to rise in temperature, ink 20 flowed out from ink tank 12 can be fully retained in temporary ink collector 16. Because of these features, there is no risk of forward leakage of ink 20 from the writing tip due to increase in temperature even if ink tank 12 is charged with a quick drying ink, that is, an ink which permits its drawn lines on a non-absorptive surface such as plastic surface, glass surface or the like and a hydrophobic or repellent surface having poor wettability, to dry fast without being repelled.

Next, the free-ink type writing instrument of the present invention will be described in further detail including examples and comparative examples.

(EXAMPLE 1)

A free-ink type writing instrument 10 having a structure shown in FIG. 1 was constructed such that a temporary ink collector 16 (sectionally comb-shaped molding made of polypropylene) was arranged between a polypropylene ink tank 12 and a pen core 18 made up of a polyester fiber bundle.

The volume of the ink tank was 2 cc and the storage volume of the temporary ink collector was 0.65 cc. The temporary ink collector and the ink tank were separated by partitioning wall 14 having air replacement hole 22 of a channel narrower than any of the comb-toothed gaps in the temporary ink collector Further, the pen core which was arranged penetrating through the temporary ink collector was projected into the ink tank.

Three samples of free-ink type writing instrument 10 were prepared with their ink tanks charged up to half, two thirds and one third of the ink tank volume Vo with an ink which was formulated based on ethanol as the main solvent so as to have a surface tension of 21 mN/m at a temperature of 25° C. with a vapor pressure of 58 mmHg and a density of 0.86 g/cc.

While the free-ink typewriting instruments thus obtained as example 1 were capped and put with their writing tips downwards, the ambient temperature was gradually increased from 25° C. to 50° C. and kept at 50° C. for one hour. Thereafter, the cap was removed from each sample, and the process of ink flowing into the temporary ink collector was observed. The result is shown in Table 1. Then, at a temperature of 25° C., the ambient pressure was gradually reduced from 1 atm. to 0.75 atm., and the process of ink flowing into the temporary ink collector was observed. The result is shown in Table 2. The free-ink type writing instrument of this example was proved to be good and free from any problem. Thereafter, drawing on a polypropylene film was tested with the free-ink type writing instruments thus obtained as example 1. The result is shown in Table 3. From the result shown in Table 3, the free-ink type writing instruments obtained as example 1 were proved to produce good drawn lines without any drawn line being repellent. The drawn line drying property was also markedly good compared to water-based ink.

(EXAMPLE 2)

A free-ink type writing instrument 10 having a structure shown in FIG. 2 was constructed such that a plasma surface-treated temporary ink collector 16 (sectionally comb-shaped molding made of ABS) was arranged between a polypropylene ink tank 12 and a polyester pen core 18. The volume of the ink tank was 2 cc and the storage volume Vc of the temporary ink collector was 0.55 cc. The temporary ink collector and the ink tank were separated by partitioning wall 14 having an air replacement hole 22 of a channel narrower than any of the comb-toothed gaps in the temporary ink collector. Further, the pen core which was arranged penetrating through the temporary ink collector was projected into the ink tank.

Three samples of the free-ink type writing instrument were prepared with their ink tanks charged up to half, two thirds and one third of the ink tank volume Vo with an ink 20 which was formulated based on water as the main solvent so as to have a surface tension of 26 mN/m at a temperature of 25° C. with a vapor pressure of 23 mmHg and a density of 1.08 g/cc.

While the free-ink typewriting instruments thus obtained as example 2 were capped and put with their writing tips downwards, the ambient temperature was gradually increased from 25° C. to 50° C. and kept at 50° C. for one hour. Thereafter, the cap was removed from each sample, and the process of ink flowing into the temporary ink collector was observed. The result is shown in Table 1. No ink leaked out from the writing tip while the temporary ink collector did not become full, leaving some margin. Then, at a temperature of 25° C., the ambient pressure was gradually reduced from 1 atm. to 0.75 atm., and the process of ink flowing into the temporary ink collector was observed. The result is shown in Table 2. The free-ink type writing instrument of this example was proved to be good and free from any problem. Thereafter, drawing on a polypropylene film was tested with the free-ink type writing instruments thus obtained as example 2. The result is shown in Table 3. From the result shown in Table 3, the free-ink type writing instruments obtained as example 2 were proved to produce good drawn lines without any drawn line being repellent. The drawn line drying property was acceptable.

(EXAMPLE 3)

A free-ink type writing instrument having a structure shown in FIG. 2 was constructed such that a temporary ink collector 16 (sectionally comb-shaped molding made of polypropylene) was arranged between a polypropylene ink tank 12 and a polyester pen core 18. The ink tank volume Vo was 2 cc and the storage volume Vc of the temporary ink collector was 0.55 cc. The temporary ink collector and the ink tank were separated by partitioning wall 14 having air replacement hole 22 of a channel narrower than any of the comb-toothed gaps in the temporary ink collector. Further, the pen core which was arranged penetrating through the temporary ink collector was projected into the ink tank.

Three samples of the free-ink type writing instrument were prepared with their ink tanks charged up to half, two thirds and one third of the ink tank volume Vo with an ink which was formulated based on water as the main solvent so as to have a surface tension of 22 mN/m at a temperature of 25° C. with a vapor pressure of 22 mmHg and a density of 1.08 g/cc.

While the free-ink typewriting instruments thus obtained as example 3 were capped and put with their writing tips downwards, the ambient temperature was gradually increased from 25° C. to 50° C. and kept at 50° C. for one hour. Thereafter, the cap was removed from each sample, and the process of ink flowing into the temporary ink collector was observed. The result is shown in Table 1. No ink leaked out from the writing tip while the temporary ink collector did not become full, leaving some margin. Then, at a temperature of 25° C., the ambient pressure was gradually reduced from 1 atm. to 0.75 atm., and the process of ink flowing into the temporary ink collector was observed. The result is shown in Table2. The free-ink type writing instrument of this example was proved to be good and free from any problem. Thereafter, drawing on a polypropylene film was tested with the free-ink type writing instruments thus obtained as example 3. The result is shown in Table 3. From the result shown in Table 3, the free-ink type writing instruments obtained as example 3 were proved to produce good drawn lines without any drawn line being repellent. The drawn line drying property was acceptable.

(EXAMPLE 4)

A free-ink type writing instrument having a structure shown in FIG. 2 was constructed such that a temporary ink collector 16 (sectionally comb-shaped molding made of polypropylene) was arranged between a polypropylene ink tank 12 and a polyester pen core 18. The ink tank volume Vo was 2 cc and the storage volume Vc of the temporary ink collector was 0.55 cc. The temporary ink collector and the ink tank were separated by partitioning wall 14 having air replacement hole 22 of a channel narrower than any of the comb-toothed gaps in the temporary ink collector. Further, the pen core which was arranged penetrating through the temporary ink collector was projected into the ink tank.

Three samples of the free-ink type writing instrument were prepared with their ink tanks charged up to half, two thirds and one third of the ink tank volume Vo with an ink which was formulated based on propylene glycol monomethyl-ether(to be referred to hereinbelow as PGM) as the main solvent so as to have a surface tension of 25 mN/m at a temperature of 25° C. with a vapor pressure of 10 mmHg and a density of 0.93 g/cc.

While the free-ink typewriting instruments thus obtained as example 4 were capped and put with their writing tips downwards, the ambient temperature was gradually increased from 25° C. to 50° C. and kept at 50° C. for one hour. Thereafter, the cap was removed from each sample, and the process of ink flowing into the temporary ink collector was observed. The result is shown in Table 1. No ink leaked out from the writing tip while the temporary ink collector did not become full, leaving some margin. Then, at a temperature of 25° C., the ambient pressure was gradually reduced from 1 atm. to 0.75 atm., and the process of ink flowing into the temporary ink collector was observed. The result is shown in Table 2. The free-ink type writing instrument of this example was proved to be good and free from any problem. Thereafter, drawing on a polypropylene film was tested with the free-ink type writing instruments thus obtained as example 4. The result is shown in Table 3. From the result shown in Table 3, the free-ink type writing instruments obtained as example 4 were proved to produce good drawn lines without any drawn line being repellent. The drawn line drying property was acceptable.

(EXAMPLE 5)

A free-ink type writing instrument having a structure shown in FIG. 3 was constructed such that a temporary ink collector (a group of vanes made of polyester arranged in layers) was arranged between a polypropylene ink tank and a polyester pen core. The ink tank volume Vo was 3.0 cc and the storage volume Vc of the temporary ink collector was 0.6 cc. The temporary ink collector and the ink tank were separated by a partitioning wall having an air replacement hole. Further, the pen core which was arranged penetrating through the temporary ink collector was projected into the ink tank.

Three samples of the free-ink type writing instrument were prepared with their ink tanks charged up to half, two thirds and one third of the ink tank volume Vo with an ink which was formulated based on water as the main solvent so as to have a surface tension of 29 mN/m at a temperature of 25° C. with a density of 1.1 g/cc.

While the free-ink typewriting instruments thus obtained as example 5 were capped and put with their writing tips downwards, the ambient temperature was gradually increased from 25° C. to 50° C. and kept at 50° C. for one hour. Thereafter, the cap was removed from each sample, and the process of ink flowing into the temporary ink collector was observed. The result is shown in Table 1. No ink leaked out from the writing tip while the temporary ink collector did not become full, leaving some margin. Then, at a temperature of 25° C., the ambient pressure was gradually reduced from 1 atm. to 0.75 atm., and the process of ink flowing into the temporary ink collector was observed. The result is shown in Table 2. The free-ink type writing instrument of this example was proved to be good and free from any problem. Thereafter, drawing on a polypropylene film was tested with the free-ink type writing instruments thus obtained as example 5. The result is shown in Table 3. From the result shown in Table 3, the free-ink type writing instruments obtained as example 5 were proved to produce good drawn lines without any drawn line being repellent. The drawn line drying property was acceptable.

Next, comparative examples of free-ink type writing instruments associated with the present invention will be described.

(Comparative Example 1)

A free-ink type writing instrument having a structure shown in FIG. 4 was constructed such that a temporary ink collector (a group of vanes arranged in layers) was arranged between a polypropylene ink tank and a polyester pen core. The ink tank volume Vo was 2.0 cc and the storage volume Vc of the temporary ink collector was 0.3 cc. The temporary ink collector and the ink tank were separated by a partitioning wall having an air replacement hole. Further, the pen core which was arranged penetrating through the temporary ink collector was projected into the ink tank.

Three samples of the free-ink type writing instrument were prepared with their ink tanks charged up to half, two thirds and one third of the ink tank volume Vo with an ink which was formulated based on ethanol as the main solvent so as to have a surface tension of 21 mN/m at a temperature of 25° C. with a density of 0.8 g/cc.

While the free-ink typewriting instruments thus obtained as comparative example 1 were capped and put with their writing tips downwards, the ambient temperature was gradually increased from 25° C. to 50° C. and kept at 50° C. for one hour. Thereafter, the cap was removed from each sample, and the process of ink flowing into the temporary ink collector was observed. The result is shown in Table 1. Then, at a temperature of 25° C., the ambient pressure was gradually reduced from 1 atm. to 0.75 atm., and the process of ink flowing into the temporary ink collector was observed. The result is shown in Table 2. As understood from the results shown in Tables 1 and 2, the free-ink type writing instrument of comparative example 1 was found to cause ink leakage from the writing tip when the empty volume inside the ink tank became large.

(Comparative Example 2)

A free-ink type writing instrument having a structure shown in FIG. 5 was constructed such that a temporary ink collector (sectionally comb-shaped molding made of ABS) was arranged between a polypropylene ink tank and a polyester pen core. The ink tank volume Vo was 2.1 cc and the storage volume Vc of the temporary ink collector was 0.32 cc. The temporary ink collector and the ink tank were separated by a partitioning wall having an air replacement passage. Further, the pen core which was arranged penetrating through the temporary ink collector was projected into the ink tank.

Three samples of the free-ink type writing instrument were prepared with their ink tanks charged up to half, two thirds and one third of the ink tank volume Vo with an ink which was formulated based on water as the main solvent so as to have a surface tension of 40 mN/m at a temperature of 25° C. with a density of 1.08 g/cc.

While the free-ink type writing instruments thus obtained as comparative example 2 were capped and put with their writing tips downwards, the ambient temperature was gradually increased from 25° C. to 50° C. and kept at 50° C. for one hour. Thereafter, the cap was removed from each sample, and the process of ink flowing into the temporary ink collector was observed. The result is shown in Table 1. Then, at a temperature of 25° C., the ambient pressure was gradually reduced from 1 atm. to 0.75 atm., and the process of ink flowing into the temporary ink collector was observed. The result is shown in Table 2. As understood from the results shown in Tables 1 and 2, the free-ink type writing instrument of comparative example 2 was found to cause ink leakage from the writing tip when the empty volume inside the ink tank became large.

(Comparative Example 3)

A free-ink type writing instrument having a structure shown in FIG. 4 was constructed such that a temporary ink collector (sectionally comb-shaped molding made of polypropylene) was arranged between a polypropylene ink tank and a polyester pen core. The ink tank volume Vo was 2.0 cc and the storage volume Vc of the temporary ink collector was 0.3 cc. The temporary ink collector and the ink tank were separated by a partitioning wall having an air replacement passage. Further, the pen core which was arranged penetrating through the temporary ink collector was projected into the ink tank.

Three samples of the free-ink type writing instrument were prepared with their ink tanks charged up to half, two thirds and one third of the ink tank volume Vo with an ink which was formulated based on water as the main solvent so as to have a surface tension of 24 mN/m at a temperature of 25° C. with a density of 1.08 g/cc.

While the free-ink typewriting instruments thus obtained as comparative example 3 were capped and put with their writing tips downwards, the ambient temperature was gradually increased from 25° C. to 50° C. and kept at 50° C. for one hour. Thereafter, the cap was removed from each sample, and the process of ink flowing into the temporary ink collector was observed. The result is shown in Table 1. Then, at a temperature of 25° C., the ambient pressure was gradually reduced from 1 atm. to 0.75 atm., and the process of ink flowing into the temporary ink collector was observed. The result is shown in Table 2. As understood from the results shown in Tables 1 and 2, the free-ink type writing instrument of comparative example 3 was found to cause ink leakage from the writing tip when the empty volume inside the ink tank became large.

(EXAMPLE 6)

A free-ink type writing instrument having a structure shown in FIG. 1 was constructed such that a temporary ink collector (sectionally comb-shaped molding made of ABS) was arranged between a polypropylene ink tank and a polyester pen core. The volume Vo of the ink tank was 2.0 cc and the storage volume Vc of the temporary ink collector was 0.65 cc. The temporary ink collector and the ink tank were separated by a partitioning wall having an air replacement passage. Further,the pen core which was arranged penetrating through the temporary ink collector was projected into the ink tank.

Three samples of the free-ink type writing instrument were prepared with their ink tanks charged up to half, two thirds and one third of the ink tank volume Vo with an ink which was formulated based on water as the main solvent so as to have a surface tension of 40 mN/m at a temperature of 25° C. with a density of 1.08 g/cc.

While the free-ink typewriting instruments thus obtained as example 6 were capped and put with their writing tips downwards, the ambient temperature was gradually increased from 25° C. to 50° C. and kept at 50° C. for one hour. Thereafter, the cap was removed from each sample, and the process of ink flowing into the temporary ink collector was observed. The result is shown in Table 1. Then, at a temperature of 25° C., the ambient pressure was gradually reduced from 1 atm. to 0.75 atm., and the process of ink flowing into the temporary ink collector was observed. The result is shown in Table 2.

As understood from Tables 1 and 2, the free-ink type writing instrument of example 6 showed freedom from problems similar to examples 1 through 5. However, as seen in Table 3, the drawing performance on a polypropylene film was found to be rather inferior as compared to examples 1 through 5.

(EXAMPLE 7)

A free-ink type writing instrument having a structure shown in FIG. 1 was constructed such that a temporary ink collector (sectionally comb-shaped molding made of polypropylene) was arranged between a polypropylene ink tank and a polyester pen core. The volume Vo of the ink tank was 2.0 cc and the storage volume Vc of the temporary ink collector was 0.65 cc. The temporary ink collector and the ink tank were separated by a partitioning wall having an air replacement passage. Further, the pen core which was arranged penetrating through the temporary ink collector was projected into the ink tank.

Three samples of the free-ink type writing instrument were prepared with their ink tanks charged up to half, two thirds and one third of the ink tank volume Vo with an ink which was formulated based on polypropylene glycol as the main solvent so as to have a surface tension of 34 mN/m at a temperature of 25° C. with a density of 1.04 g/cc.

While the free-ink typewriting instruments thus obtained as example 7 were capped and put with their writing tips downwards, the ambient temperature was gradually increased from 25° C. to 50° C. and kept at 50° C. for one hour. Thereafter, the cap was removed from each sample, and the process of ink flowing into the temporary ink collector was observed. The result is shown in Table 1. Then, at a temperature of 25° C., the ambient pressure was gradually reduced from 1 atm. to 0.75 atm., and the process of ink flowing into the temporary ink collector was observed. The result is shown in Table 2.

As understood from Tables 1 and 2, the free-ink type writing instrument of example 7 showed freedom from problems similar to examples 1 through 5. However, as seen in Table 3, the drawing performance on a polypropylene film was found to be rather inferior as compared to examples 1 through 5.

(Comparative Example 4)

A free-ink type writing instrument having a structure shown in FIG. 6 was constructed such that a temporary ink collector (sectionally comb-shaped molding made of polypropylene) was arranged between a polypropylene ink tank and a polyester pen core. The ink tank volume Vo was 2.0 cc and the storage volume Vc of the temporary ink collector was 0.2 cc. The temporary ink collector and the ink tank were separated by a partitioning wall having an air replacement passage. Further,the pen core which was arranged penetrating through the temporary ink collector was projected into the ink tank.

Three samples of the free-ink type writing instrument were prepared with their ink tanks charged up to half, two thirds and one third of the ink tank volume Vo with an ink which was formulated based on PGM(propylene glycol mono-methyl-ether) as the main solvent so as to have a surface tension of 24 mN/m at a temperature of 25° C. with a density of 0.98 g/cc.

While the free-ink typewriting instruments thus obtained as comparative example 4 were capped and put with their writing tips downwards, the ambient temperature was gradually increased from 25° C. to 50° C. and kept at 50° C. for one hour. Thereafter, the cap was removed from each sample, and the process of ink flowing into the temporary ink collector was observed. The result is shown in Table 1. Then, at a temperature of 25° C., the ambient pressure was gradually reduced from 1 atm. to 0.75 atm., and the process of ink flowing into the temporary ink collector was observed. The result is shown in Table 2. As understood from the results shown in Tables 1 and 2, ink leakage was unequivocally observed from the writing tip.

In Table 1, the evaluation criteria used in observation of the process of ink being stored into the temporary ink collector when each sample with its ink tank charged up to half, two thirds or one third of the ink tank volume Vo was subjected to ambient change in temperature from 25° C. to 50° C., were as follows:

'Good': the ink displaced with expansion of the air volume in the ink tank was fully retained in the temporary ink collector without causing any leakage from the front side of the pen core; and 'Bad': the ink displaced with expansion of the air volume in the ink tank filled the temporary ink collector and leaked out from the front side of the pen core.

TABLE 1

| | Temporary Ink Collector Storage Volume Vc (cc) | Ink Tank Volume Vo (cc) | Ink Volume Ratio (Vc/Vo) | Ink Charge Ratio (2/3) | Ink Charge Ratio (1/2) | Charge Ratio (1/3) |
|---|---|---|---|---|---|---|
| Ex. 1 | 0.65 | 2.0 | 0.325 | Good | Good | Good |
| Ex. 2 | 0.55 | 2.0 | 0.275 | Good | Good | Good |
| Ex. 3 | 0.55 | 2.0 | 0.275 | Good | Good | Good |
| Ex. 4 | 0.55 | 2.0 | 0.275 | Good | Good | Good |
| Ex. 5 | 0.60 | 3.0 | 0.200 | Good | Good | Good |
| CEx. 1 | 0.30 | 2.0 | 0.150 | Good | Bad | Bad |
| CEx. 2 | 0.32 | 2.1 | 0.152 | Good | Bad | Bad |
| CEx. 3 | 0.30 | 2.0 | 0.150 | Good | Bad | Bad |
| Ex. 6 | 0.65 | 2.0 | 0.325 | Good | Good | Good |
| Ex. 7 | 0.65 | 2.0 | 0.325 | Good | Good | Good |
| CEx. 4 | 0.20 | 2.0 | 0.100 | Good | Bad | Bad |

In Table 2, the evaluation criteria used in observation of the process of ink being stored into the temporary ink collector when each sample with its ink tank charged up to half, two thirds or one third of the ink tank volume Vo was subjected to ambient change in pressure from 1 atm. to 0.75 atm., were as follows:

'Good': the ink displaced with expansion of the air volume in the ink tank was fully retained in the temporary ink collector without causing any leakage from the front side of the pen core; and 'Bad': the ink displaced with expansion of the air volume in the ink tank filled the temporary ink collector and leaked out from the front side of the pen core.

TABLE 2

| | Temporary Ink Collector Storage Volume Vc (cc) | Ink Tank Volume Vo (cc) | Volume Ratio (Vc/Vo) | Ink Charge Ratio (2/3) | Ink Charge Ratio (1/2) | Ink Charge Ratio (1/3) |
|---|---|---|---|---|---|---|
| Ex. 1 | 0.65 | 2.0 | 0.325 | Good | Good | Good |
| Ex. 2 | 0.55 | 2.0 | 0.275 | Good | Good | Good |
| Ex. 3 | 0.55 | 2.0 | 0.275 | Good | Good | Good |
| Ex. 4 | 0.55 | 2.0 | 0.275 | Good | Good | Good |
| Ex. 5 | 0.60 | 3.0 | 0.200 | Good | Good | Good |
| CEx. 1 | 0.30 | 2.0 | 0.150 | Good | Bad | Bad |
| CEx. 2 | 0.32 | 2.1 | 0.152 | Good | Bad | Bad |
| CEx. 3 | 0.30 | 2.0 | 0.150 | Good | Bad | Bad |
| Ex. 6 | 0.65 | 2.0 | 0.325 | Good | Good | Good |
| Ex. 7 | 0.65 | 2.0 | 0.325 | Good | Good | Good |
| CEx. 4 | 0.20 | 2.0 | 0.100 | Bad | Bad | Bad |

In Table 3, the evaluation criteria used in observation of the dryability of drawn lines and the writability on writing surfaces were as follows:

'Good' indicates a state where drawn lines dry up within one minute after writing and cause no smudge by rubbing and will not be repellent on polypropylene film (PP film); and 'Bad' indicates a state where drawn lines do not dry up after one minute forth after writing and cause smudges by rubbing and are repellent on polypropylene film (PP film).

TABLE 3

| | Temporary Ink Collector Storage Volume Vc (cc) | Ink Tank Volume Vo (cc) | Volume Ratio (Vc/Vo) | Drawn Line Dry-ability | Write-ability on PP film |
|---|---|---|---|---|---|
| Ex. 1 | 0.65 | 2.0 | 0.325 | Good | Good |
| Ex. 2 | 0.55 | 2.0 | 0.275 | Good | Good |
| Ex. 3 | 0.51 | 2.0 | 0.275 | Good | Good |
| Ex. 4 | 0.55 | 2.0 | 0.275 | Good | Good |
| Ex. 5 | 0.60 | 3.0 | 0.200 | Good | Good |
| CEx. 1 | 0.30 | 2.0 | 0.150 | Good | Good |
| CEx. 2 | 0.32 | 2.1 | 0.152 | Good | Bad |
| CEx. 3 | 0.30 | 2.0 | 0.150 | Good | Bad |
| Ex. 6 | 0.65 | 2.0 | 0.325 | Good | Bad |
| Ex. 7 | 0.65 | 2.0 | 0.325 | Bad | Bad |
| CEx. 4 | 0.20 | 2.0 | 0.100 | Good | Good |

As has been described, according to the free-ink type writing instrument of the present invention, since the storage volume Vc of the ink collector and the ink tank volume Vo are adapted to satisfy the relation: $Vc \geqq 0.18\ Vo$, it is possible to provide a free-ink type writing instrument which is able to use an ink having resistance against drawn line repellence on a writing surface with a poor wettability and excellent in drawn line dryability, still can retain all the ink flowing out from the ink tank by the temporary ink collector without causing any ink leakage such as ink ejection from the writing tip if a sharp change in external pressure or sharp expansion or contraction of air inside the ink tank occurs and which can be assembled easily at a low cost by automation.

What is claimed is:

1. A free-ink type writing instrument comprising:

an ink tank for holding ink;

a temporary ink collector for temporarily retaining the ink flowing out from the ink tank;

a partitioning wall separating the ink tank and the temporary ink collector; and a pen core disposed from the ink tank, penetrating through the partitioning wall and the ink collector so as to allow ink to flow out from the ink tank, characterized in that the ink stored in the ink tank has a vapor pressure ranging from 20 mmHg to 60 mmHg at a temperature of 25° C. and a surface tension of less than 30 mN/m at a temperature of 25° C., and the storage volume Vc of the ink collector and the ink tank volume Vo satisfy the relation $Vc \geqq 0.18\ Vo$.

* * * * *